US007555919B2

(12) United States Patent
Krauss

(10) Patent No.: US 7,555,919 B2
(45) Date of Patent: Jul. 7, 2009

(54) NEEDLE BED WITH COOLING CHANNEL

(75) Inventor: Rainer Krauss, Zell u. A. (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/000,781

(22) Filed: Dec. 17, 2007

(65) Prior Publication Data

US 2008/0282744 A1 Nov. 20, 2008

(30) Foreign Application Priority Data

Dec. 15, 2006 (EP) ..... 06025999

(51) Int. Cl.
*D04B 35/30* (2006.01)

(52) U.S. Cl. ..... 66/115; 66/168

(58) Field of Classification Search ..... 66/168, 66/8, 1 R, 114, 115
See application file for complete search history.

(56) References Cited

U.S. PATENT DOCUMENTS 4,741,181 A * 5/1988 Plath ..... 66/104
5,408,850 A * 4/1995 Kawase et al. ..... 66/168
6,199,408 B1 * 3/2001 Shibata ..... 66/8
7,036,340 B1 * 5/2006 Chen ..... 66/8
7,043,941 B2 * 5/2006 Willmer et al. ..... 66/168
7,269,977 B1 * 9/2007 Pai ..... 66/168

FOREIGN PATENT DOCUMENTS

DE 4024 101 C2 11/1999
EP 1293 235 10/1972

* cited by examiner

*Primary Examiner*—Danny Worrell
(74) *Attorney, Agent, or Firm*—Norman N. Kunitz; Fitch, Even, Tabin & Flannery

(57) ABSTRACT

A needle bed (1) of a knitting machine has a segmented configuration. The segments (5, 6) border against each other via the abutment surfaces (10, 8). Extending from at least one of the boundary surfaces (10, 8) are cooling channels that are provided, e.g., in the segment (6). The adjacent segment (5) covers these cooling channels, thereby closing said cooling channels.

9 Claims, 6 Drawing Sheets

NEEDLE BED WITH COOLING CHANNEL

CROSS REFERENCE TO RELATED APPLICATION

This application claims the priority of European patent application No. 06 025 999.1, filed Dec. 15, 2006, the subject matter, in its entirety, is incorporated by reference.

BACKGROUND OF THE INVENTION

The invention relates to a needle bed for a knitting machine.

Knitting machines comprise needle beds, for example, in the form of knitting cylinders, dials or also in the form of flat needle beds. It may become necessary to cool needle beds. To achieve this, document DE 40 24 101 C2 suggests to machine a groove on the inside circumferential area of a needle cylinder, said groove being sealed by an annular lid. Connectors on the lid allow the feeding and discharging of cooling water.

Cylinders of knitting machines may reach a relatively large diameter. In this case, the annular lid will also have a correspondingly large diameter. Regardless of occurring temperature fluctuations or other influences, said lid must form a permanent seal with the knitting cylinder.

Furthermore, it has been known from document DE 39 38 685 C2 to provide a cooling pipe on the knitting cylinder in order to cool the knitting cylinder, said cooling pipe extending in coils, or also meandering, around the inside circumference of the knitting cylinder and being partially set into said knitting cylinder.

Furthermore, this literature reference discloses a knitting cylinder having a hollow space with a rectangular cross-section extending in circumferential direction, said hollow space being connected—on the inside circumference of the knitting cylinder—to feed and discharge lines.

Considering this, it is the object of the invention to disclose a possibility with which cooling can be achieved on a needle bed. This object is to be achieved by a solution that can be implemented in the simplest-possible manner and that functions in a reliable manner.

SUMMARY OF THE INVENTION

The above object is generally achieved by a needle bed in accordance with the invention which consists of a minimum of two segments that border each other on abutment surfaces. The segments are preferably connected to each other. For example, they are cemented to each other on the abutment surface or they are also braced against each other by appropriate means, such as, for example, by screws. The abutment surface preferably extends transversely to the needle tricks that are provided in the needle bed.

For cooling the needle bed, at least one of said needle bed's segments has one or more cooling channels. In so doing, at least one cooling channel adjoins the abutment surface of one of the segments. This provides the possibility of a simple manufacture. For example, the cooling channel may be designed as a groove which is open toward the abutment surface. This groove, and thus the cooling channel, are closed by the adjacent segment which bridges the groove with a flat, or even contoured, abutment surface, thus closing said groove.

If the needle bed is a knitting cylinder, its segments are preferably single-part or multiple-part rings that are arranged so that their abutment surfaces adjoin each other in axial direction. If the needle bed is a dial, its segments are preferably single-part or multiple-part rings that are arranged so that their abutment surfaces adjoin each other in radial direction. In both cases, the cooling channels adjoin the abutment surfaces. Consequently, a segment closes the cooling channel of the next adjacent segment. Separate lids, closing means and the like are not required. Thus the cooling channels do not require any additional design space. In addition, an effective cooling of the individual segments and thus the entire needle bed is achieved because the coolant may circulate directly in the cooling channel of the segment and thus in the needle bed. There are no boundary surfaces that limit the transfer of heat, for example, between the pipe and the segment body, as is the case in prior art.

The annular segments are dimensionally stable, relatively solid elements which, in any event, are precision-machined. Consequently, sealing the cooling channels on the abutment surfaces does not represent any technical difficulties.

Basically, the cooling channel may continuously extend around the entire circumference of a segment. Preferably, however, the cooling channel is divided into individual sections, each extending only over a specific angular range of, e.g., 20°, 45°, 60°, on an abutment surface and then changing to the opposite side of the annular segment. In this manner, high mechanical stability is combined with high cooling efficiency.

In order to feed the coolant, in particular cooling oil or cooling water, to the cooling channel and in order to discharge coolant therefrom, preferably two or more connectors are provided. These are preferably aligned parallel to the needle tricks of the needle bed and extend, starting from the segment in which the cooling channel is provided, through the adjacent segment into an outer frontal connector. In the case of a knitting cylinder, said latter connector is preferably provided on the lower annular front surface. In the case of dials, the connectors are preferably located on the outside circumferential surface of the largest annular segment.

Additional details of embodiments in accordance with the invention are the subject matter of the drawings, the description or of the claims. The description is restricted to essential aspects of the invention and miscellaneous situations. Additional details can be learned from the drawings which are to be used for supplemental reference. The drawings show exemplary embodiments of the invention. They are not true to scale and are restricted to the illustration of a few details that are required for understanding.

DETAILED DESCRIPTION OF THE INVENTION

Figure 1:
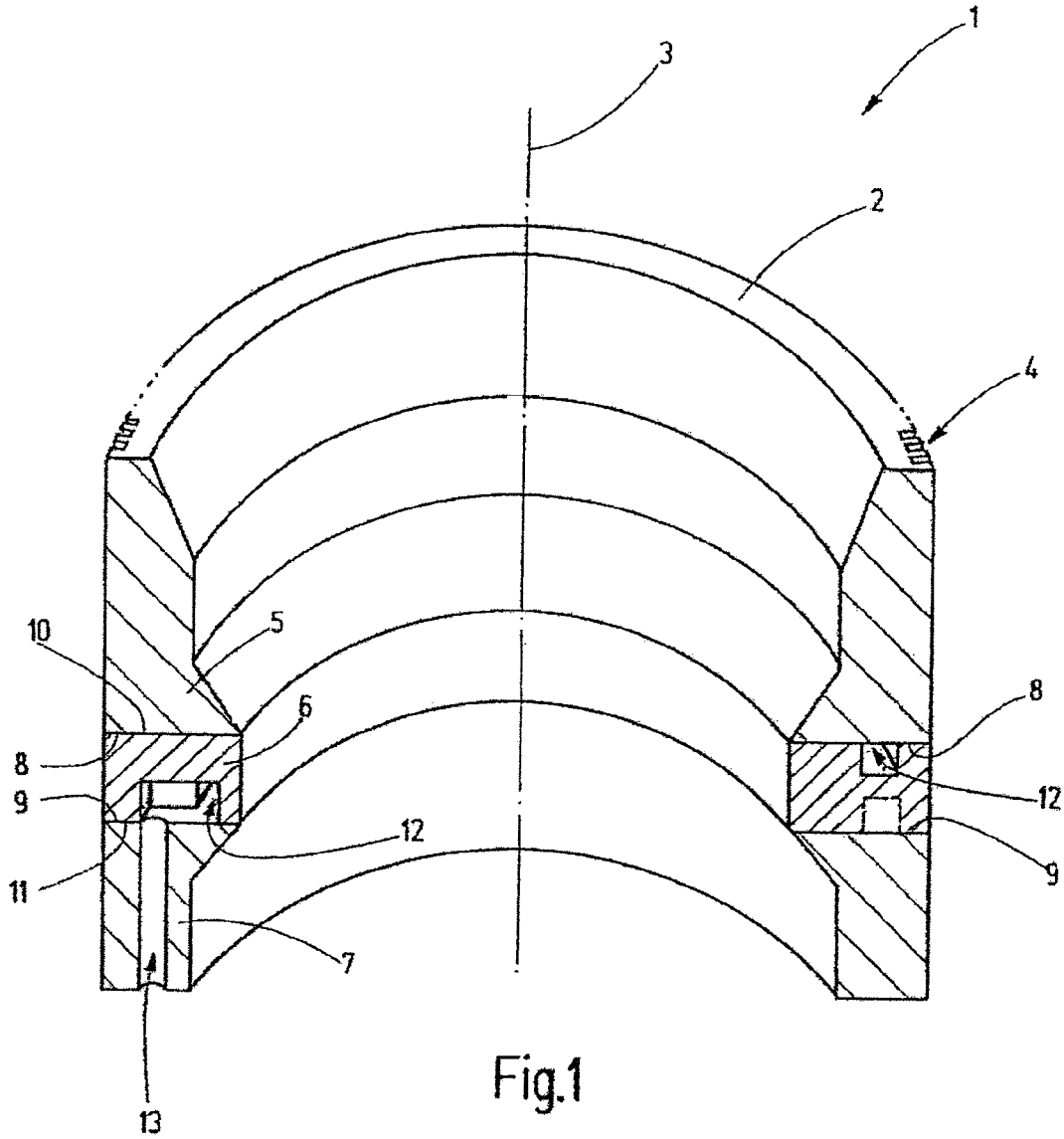
FIG. 1 is a perspective, cut open and schematic view of a knitting cylinder.

FIG. 1 shows a needle bed 1 configured as a knitting cylinder 2 of a circular knitting machine. On its outside circumferential surface, the knitting cylinder 2 has needle tricks 4 that are preferably parallel with respect to each other and with respect to the rotational axis 3 of the knitting cylinder 2. The rotational axis 3 and the needle tricks 4 usually extend in vertical direction.

The knitting cylinder 2 consists of a minimum of two, however preferably more, annular segments 5, 6, 7 that are arranged so as to be coaxial with the rotational axis 3 and adjoin each other in axial direction. The segments 5, 6, 7 are preferably configured continuously over the entire circumference and, to this extent, consist of one piece. However, if needed, they may be assembled of sections that extend only over a part of the total circumference.

The segment 6 is located between the segments 5 and 7. Said segment 6 has two abutment surfaces 8, 9 facing in opposite axial directions, said abutment surfaces being shown as flat annular surfaces in FIG. 1. The rotational axis 3 extends in a direction perpendicular to the plane in which the abutment surfaces 8, 9 may be located. However, said abutment surfaces may also be positioned on a cone that is concentric with respect to the rotational axis 3, or they may be contoured.

The segment 5 has an abutment surface 10 which is configured complementary to the abutment surface 8 and abuts against said abutment surface. The segment 7 has an abutment surface 11 that is configured complementary to the abutment surface 9 and abuts against said abutment surface. The needle tricks 4 extend along the outside beyond the segments 5, 6, 7. They may have continuous or discontinuous needle trick flanks. The radial thickness of the individual segments 5, 6, 7 may have the same or, as shown, may have different dimensions. Preferably, the segment 6 located between the segments 5 and 7 has the greatest radial thickness. The segment 6 is preferably positioned in the axial position, in which the knitting tools seated in the needle tricks 4 come into engagement with the knitting lock during operation. The knitting lock is arranged like a ring around the needle cylinder 2. The knitting tools held in the needle tricks, in particular in the region of the segment 6, comprise appropriate means configured as feet that interact with the knitting lock.

Figure 3:
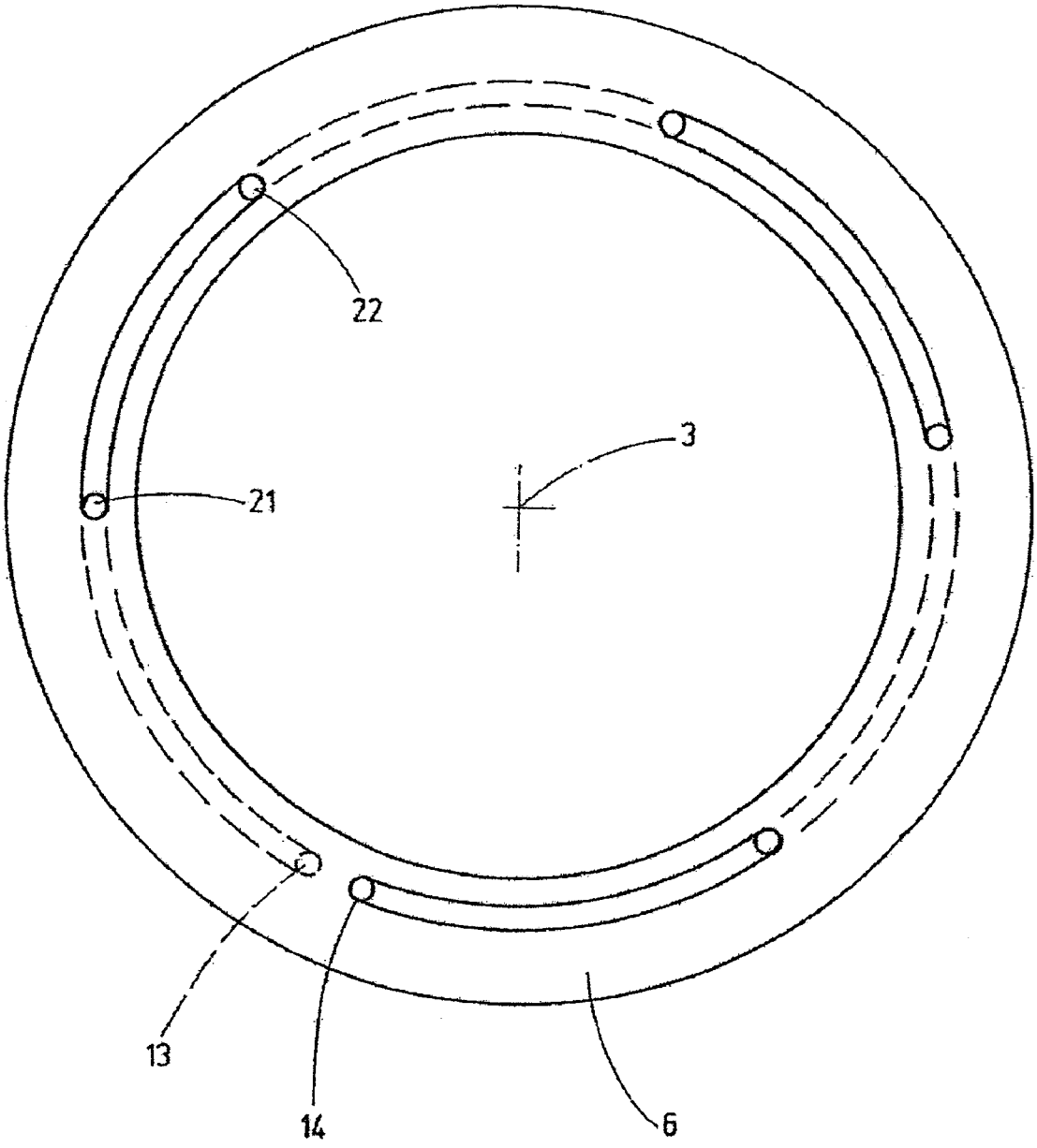
FIG. 3 is a plan view of the segment in accordance with FIG. 2.

One or more segments 5, 6, 7 are provided with cooling channels 12. Referring to the present exemplary embodiment, the segment 6 is provided with a cooling channel 12 which can be supplied with coolant via the connectors 13, 14 (FIG. 3).

Figure 2:
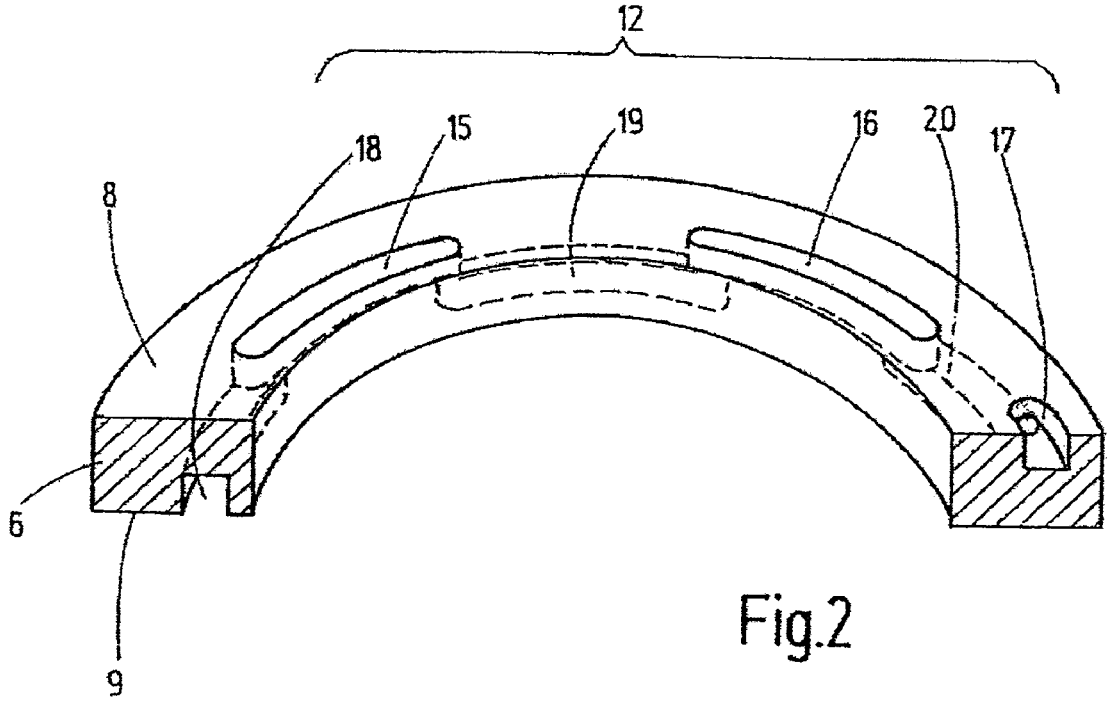
FIG. 2 is a perspective view, vertically in section, of a segment of the knitting cylinder in accordance with FIG. 1.

The cooling channel 12 adjoins at least one of the flat surfaces 8, 9. As is obvious from FIG. 2, referring to the present exemplary embodiment, said cooling channel adjoins the abutment surface 8, as well as the abutment surface 9. Said cooling channel is configured in the form of grooves 15, 16, 17, 18, 19, 20 that alternately extend from the abutment surface 8 and from the abutment surface 9. The edge of each groove is fully enclosed by the abutment surface 8 or 9. The grooves 15 through 20 form a circular arc around the rotational axis 3. Their number can be decided as needed. However, it may be greater or smaller, as shown by FIGS. 2 and 3. The grooves of the two different sides are connected to each other by bores 21, 22 (FIG. 3) and thus form a chain that extends from the connector 13 to the connector 14 and thus essentially encompasses the entire circumference of the segment 6.

The abutment surfaces 8, 9, 10, 11 are preferably sealing surfaces that can be sealed relative to each other by an adhesive, by another sealing agent or simply by a tight fit, or even by sealing elements (e.g., O-rings). In so doing, the abutment surface 10 seals the grooves 15, 16, 17 provided in the upper side of the segment 6 (FIG. 2). As opposed to this, the abutment surface 11 seals the lower grooves 18, 19, 20 (FIG. 2). The cooling channels are defined between the two adjacent segments 5, 6 and 6, 7, respectively. In the present exemplary embodiment, they are configured as groove-like pockets in the segment 6 and are simply closed by the adjacent segments 5, 7. However, it is also possible to provide grooves in the segments 5, 7, said grooves adjoining the corresponding abutment surfaces 10, 11.

The connectors 13, 14 are preferably configured as bores that project from the segment 6 in a direction parallel to the rotational axis 3 and in alignment with bores which are provided in the adjacent segment 7. Connectors may be provided on the underside of the segment 7, said connectors permitting a rotation of the knitting cylinder 2.

The function of the so-far described knitting cylinder 2 in a circular knitting machine is like the function of a conventional knitting cylinder. However, its segment 6 is cooled by a coolant, for example, cooling water or cooling oil. By cooling the segments 6, the segments 5, 7 are also slightly cooled. A heat exchange can take place via the abutment surfaces 8, 9, 10, 11. In addition, the coolant contacts not only the segment 6 but also the segments 5, 7 by way of their abutment surfaces 10, 11.

In particular, heat occurring in the region of the needle lock is removed by the coolant which flows through the segment 6.

Embodiments in accordance with the invention, where the grooves 15 through 20 are provided in different segments 6, 7, 5 are also possible. These grooves 15 through 20 are then appropriately connected to bores 21, 22, whereby, e.g., the bore 21 extends from the segment 6 via its abutment surface 8 into the segment 5 via its abutment surface 10. This may analogously apply to the bore 22, which also connects the grooves 15 through 20 and extends, e.g., from the segment 6 via its abutment surface 9, up to and into the segment 7 via its abutment surface 11.

Figure 4:
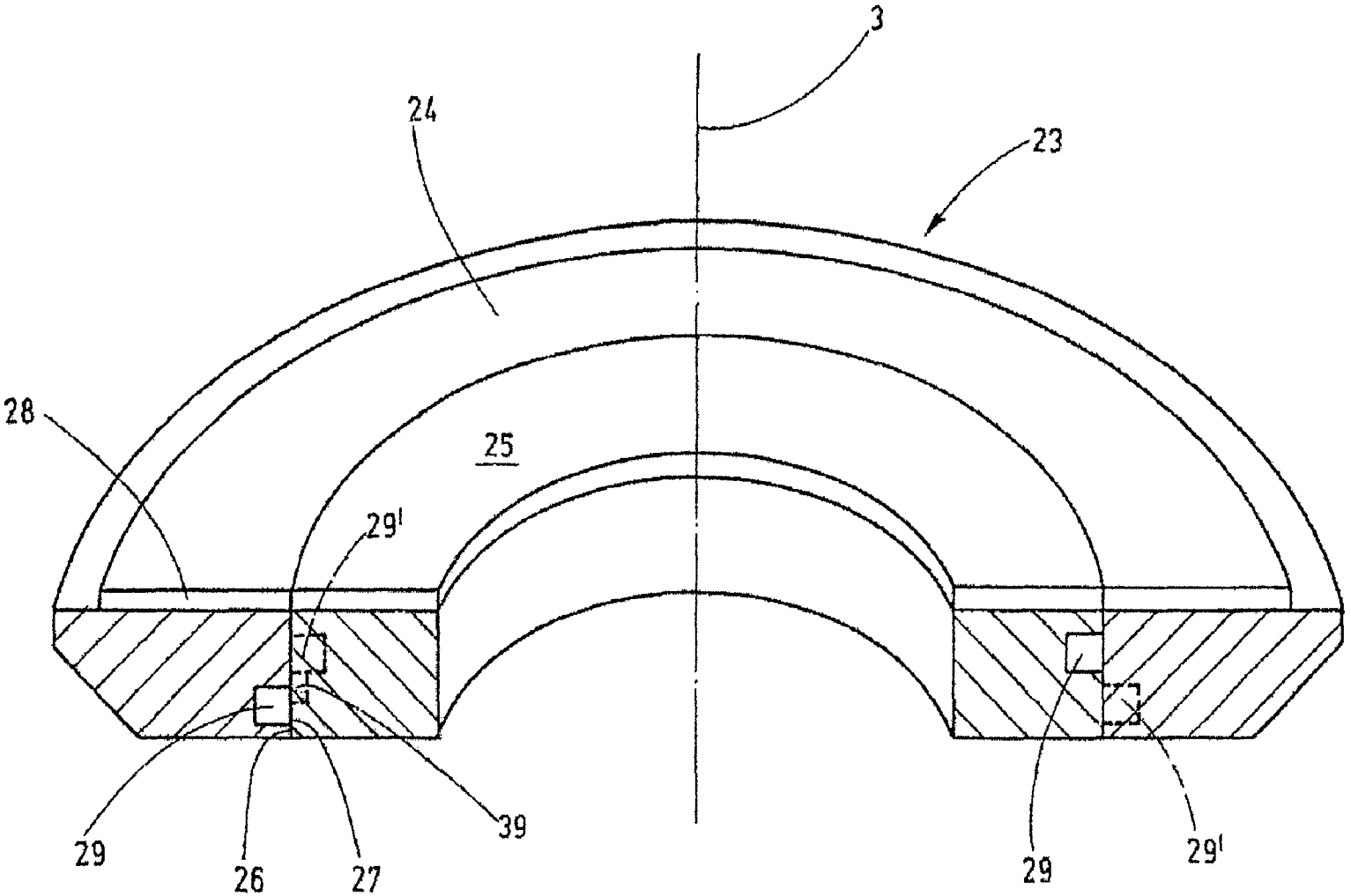
FIG. 4 is a perspective view, vertically in section, of a modified embodiment of the invention in the form of a dial.

Additional embodiments in accordance with the invention are provided. FIG. 4 shows the needle bed 1 configured as a dial 23 that consists of annular segments 24, 25. Like the segments 5, 6, 7, the segments 24, 25 are connected so that they are not counter-rotational and are arranged concentrically to the rotational axis 3. The segments 24, 25 have the abutment surfaces 26 and 27, each being formed on the inside and outside circumferential sides of the segments 24, 25 and being positioned in pairs in contact with each other. The needle tricks 28 are provided on the upper side of the thusly formed dial 23 and extend radially with respect to the rotational axis 3.

As in the previously described exemplary embodiment, again one or more cooling channels 29, 29' are provided, said channels extending at least through one of the segments 24, 25. The cooling channel 29 may again be divided into individual grooves 29, 29' configured as pockets, said pockets alternately bordering against the abutment surface 26 and the abutment surface 27 of the segments 24 and 25. The connection between the individual cooling channel sections can be achieved by connection orifices 39 between the cooling channel sections of the segment 24 and the cooling channel sections of the segment 25. The number of connection orifices 39 is a function of the number of channel sections. Two channel sections that are located in the segments 24, 25 are connected to one connection orifice 39. Connectors that are not shown in greater detail permit the supply and discharge of coolant. If desired, this principle may also be applied to the knitting cylinder in accordance with FIG. 1.

Figure 6:
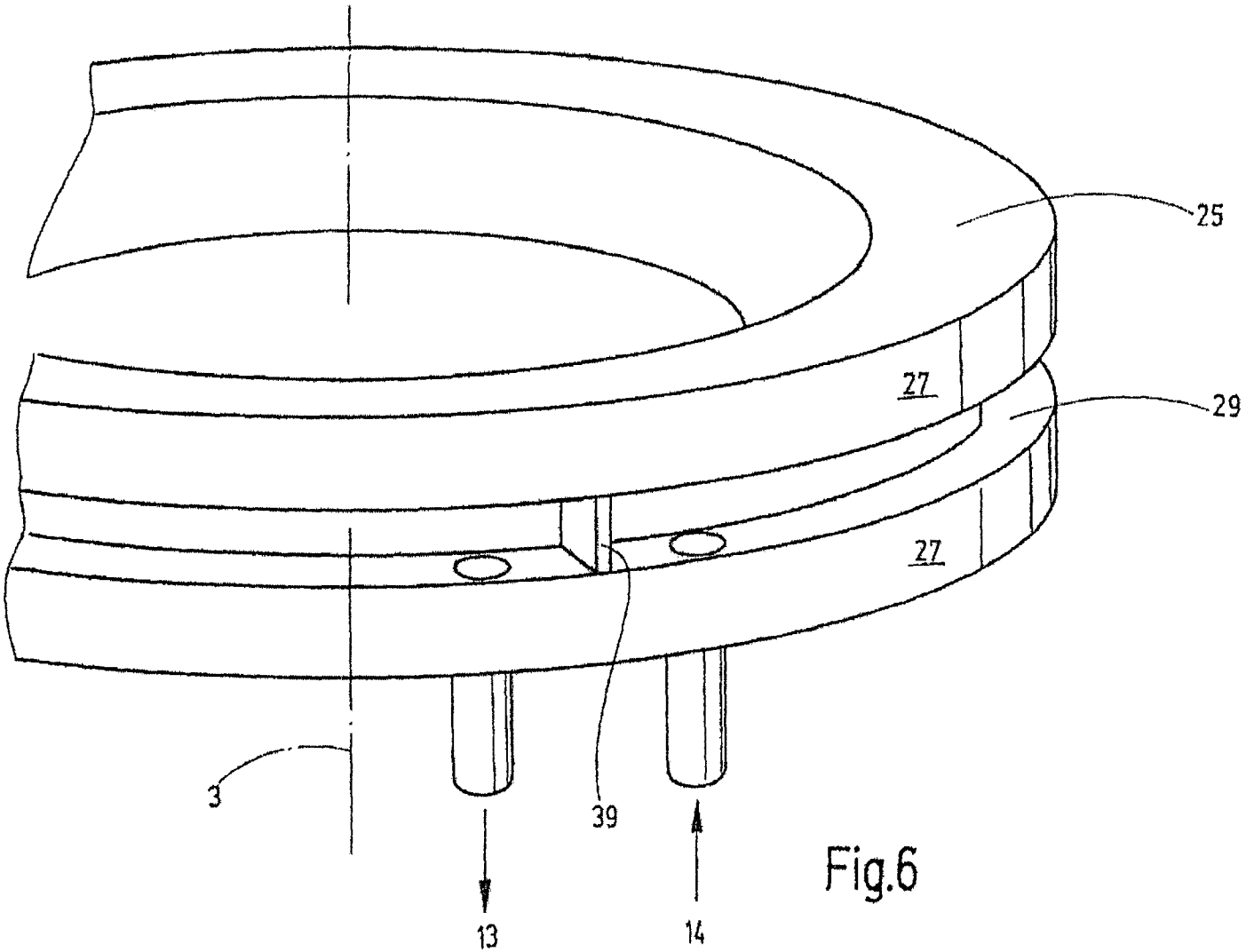
FIG. 6 is a perspective view of a segment of the dial in accordance with FIG. 4.

FIG. 6 shows the segment 25 of the dial 23. In so doing, the segment 25 has a fully surrounding cooling channel 29. Arranged around the segment 25, is the segment 24 (not shown). In so doing, the segment 24 does not have a cooling channel 29. The abutment surface 26 of said segment 24 abuts against the abutment surface 27 of the segment 25 and thus forms the bottom of the cooling channel 29 that is only provided in the segment 25. In order to achieve a favorable circulation of the coolant, the cooling channel comprises a separating means 39 in the form of a strip between the connector 13 and the connector 14. As a result of this, it is ensured that the coolant, which is introduced through the connector 14 into the segment 25, first flows around along the circumference of the segment 25 and is subsequently discharged through the connector 13. Consequently, the best-possible cooling action is achieved.

It is also possible—in addition to the circumferential cooling channel 29 in the segment 25—for the segment 24 to have a circumferential cooling channel 29', said latter cooling channel being arranged opposite the cooling channel 29 of the segment 25 (not drawn). In this case, the cooling channel 29' also contains a separating means 39. Such circumferential cooling channels can also be implemented in the knitting cylinder.

Figure 5:
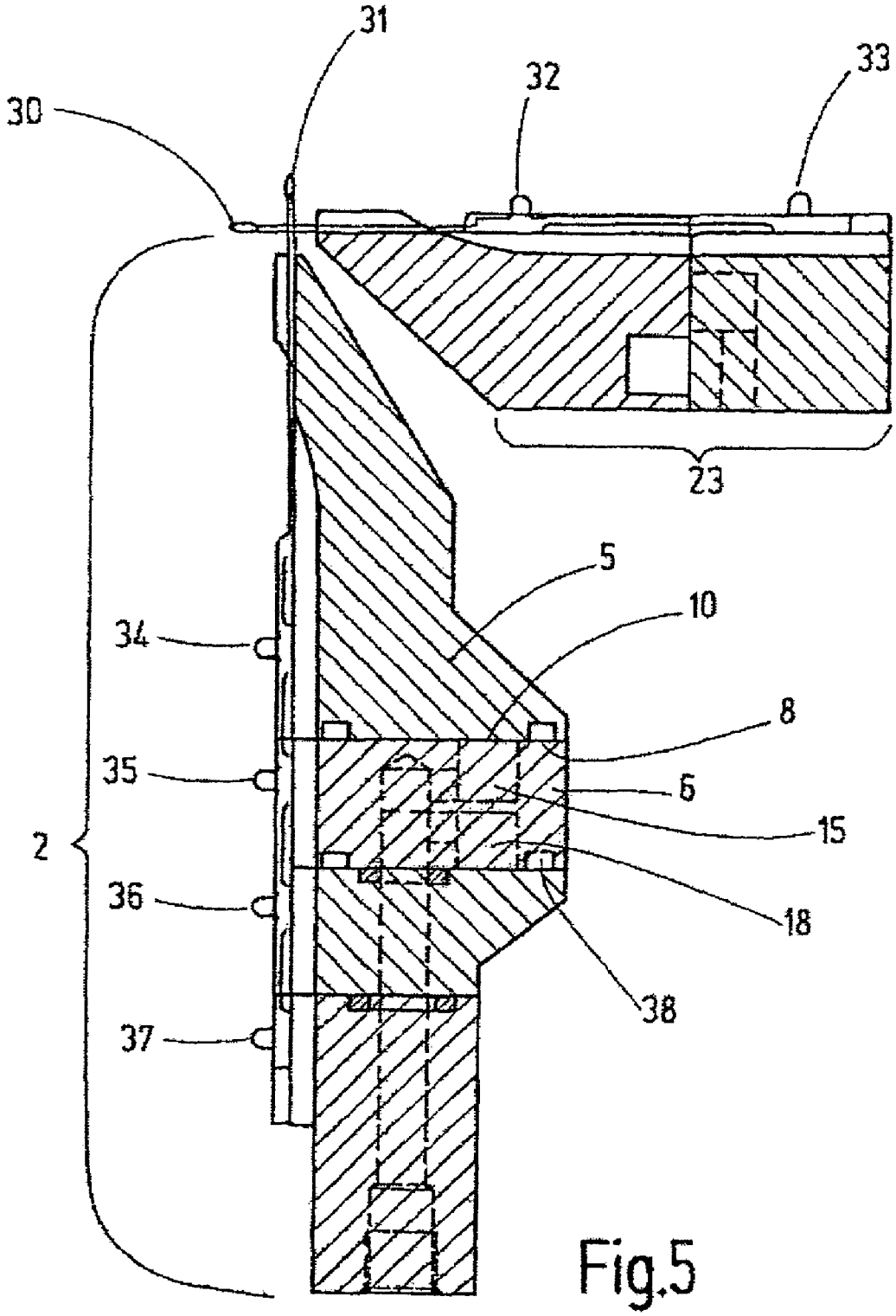
FIG. 5 is a more detailed, yet still more simplified view, vertically in section, of a knitting cylinder and a dial.

FIG. 5 shows the interaction of the knitting cylinder 2 and the dial 23 that support the appropriate knitting tools 30, 31. As is obvious, in particular the knitting tools 31 may have feet 34 through 37 at various locations, whereby, in order to cool the knitting cylinder 2, a cooling in the region of the central segment 6 is sufficient. As is further obvious from FIG. 5, the segments may be sealed relative to each other, this being potentially achieved by appropriate annular grooves 39.

A needle bed 1 of a knitting machine has a segmented configuration. The segments 5, 6 border against each other via the abutment surfaces 10, 8. Extending from at least one of the boundary surfaces 10, 8 are cooling channels that are provided, e.g., in the segment 6. The adjacent segment 5 covers these cooling channels, thereby closing said cooling channels.

It will be appreciated that the above description of the present invention is susceptible to various modifications, changes and modifications, and the same are intended to be comprehended within the meaning and range of equivalents of the appended claims.

REFERENCE NUMBERS

1 Needle bed
2 Knitting cylinder
3 Rotational axis
4 Needle tricks
5 Segment
6 Segment
7 Segment
8 Abutment surface
9 Abutment surface
10 Abutment surface
11 Abutment surface
12 Cooling channel
13 Connector
14 Connector
15-20 Grooves
21 Bore
22 Bore
23 Dial
24 Segment
25 Segment
26 Abutment surfaces
27 Abutment surfaces
28 Needle trick
29 Cooling channel
30 Knitting tool
31 Knitting tool
32 through 37 feet
38 Annular groove
39 Separating strip/separating means

The invention claimed is:

1. Needle bed for a knitting machine, said needle bed consisting of a minimum of two segments that border each other on their abutment surfaces, and wherein: in at least one of the segments, at least one cooling channel is provided, said cooling channel adjoining the abutment surface of the at least one segment and being closed by the other segment; the at least one segment has, on two sides facing away from each other, abutment surfaces that border other segments; and, each of the two sides facing away from each other adjoins cooling channel sections in the form of grooves.

2. Needle bed in accordance with claim 1, wherein the needle bed is a knitting cylinder with segments having an annular shape.

3. Needle bed in accordance with claim 1, wherein the needle bed is a dial with segments having an annular shape.

4. Needle bed in accordance with claim 1, wherein the cooling channel extends, at least in sections, along the abutment surface.

5. Needle bed in accordance with claim 4, wherein the segments of the needle bed have an annular shape, and the cooling channel extends around the entire annular segment.

6. Needle bed in accordance with claim 1, wherein the cooling channel sections are connected to each other.

7. Needle bed for a knitting machine, said needle bed consisting of a minimum of two segments that border each other on their abutment surfaces, and wherein: in at least one of the segments, at least one cooling channel is provided, said cooling channel adjoining the abutment surface of the at least one segment and being closed by the other segment; the at least one segment has, on two sides facing away from each other, abutment surfaces that border other segments; and, the cooling channel is provided so as to alternately extend along the one abutment surface and along the other abutment surface.

8. Needle bed in accordance with claim 7, wherein the cooling channel is configured so as to be fluid-tight.

9. Needle bed in accordance with claim 7, wherein connectors lead to the cooling channel, with said connectors extending at least through an adjacent segment.

* * * * *